US009352919B2

(12) United States Patent
Tsunoda

(10) Patent No.: US 9,352,919 B2
(45) Date of Patent: May 31, 2016

(54) SHEET PROCESSING APPARATUS AND IMAGE FORMING SYSTEM

(71) Applicant: Konica Minolta, Inc., Tokyo (JP)

(72) Inventor: Akira Tsunoda, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/322,061

(22) Filed: Jul. 2, 2014

(65) Prior Publication Data

US 2015/0008635 A1 Jan. 8, 2015

(30) Foreign Application Priority Data

Jul. 3, 2013 (JP) ..... 2013-139588

(51) Int. Cl.

| | |
|---|---|
| ***B65H 5/32*** | (2006.01) |
| ***B42C 1/12*** | (2006.01) |
| ***B42B 4/00*** | (2006.01) |
| ***B65H 37/04*** | (2006.01) |
| ***G03G 15/00*** | (2006.01) |

(52) U.S. Cl.

CPC .. *B65H 5/32* (2013.01); *B42B 4/00* (2013.01); *B42C 1/12* (2013.01); *B65H 37/04* (2013.01); *G03G 15/6544* (2013.01); *B65H 2301/322* (2013.01); *B65H 2408/121* (2013.01); *B65H 2801/27* (2013.01)

(58) Field of Classification Search

CPC ..... B65H 5/32; B65H 37/04; B65H 2801/27; B65H 2408/121; B42C 1/12; G03G 15/6541

USPC ..... 270/37, 52.18, 52.26, 58.08, 58.09

See application file for complete search history.

(56) References Cited

U.S. PATENT DOCUMENTS

| | | | | |
|---|---|---|---|---|
| 5,282,611 | A * | 2/1994 | Ueda et al. | 270/58.09 |
| 6,948,224 | B2 * | 9/2005 | Coombs et al. | 29/407.01 |
| 7,490,820 | B2 * | 2/2009 | Kobayashi | 270/37 |
| 7,819,615 | B2 * | 10/2010 | Trovinger et al. | 412/1 |
| 7,900,902 | B2 * | 3/2011 | Ramseier | 270/52.18 |
| 7,984,897 | B2 * | 7/2011 | Williams et al. | 270/52.18 |

(Continued)

FOREIGN PATENT DOCUMENTS

| | | |
|---|---|---|
| EP | 2236257 A2 | 10/2010 |
| JP | 09-194122 | 7/1997 |

(Continued)

OTHER PUBLICATIONS

Extended European Search Report dated Jan. 26, 2015 for the corresponding European Patent Application No. EP14175225.

(Continued)

*Primary Examiner* — Leslie A Nicholson, III

(57) ABSTRACT

A sheet processing apparatus including: an accumulating section on which a sheet is accumulated; a staple inserting section which is provided above the accumulating section; a staple receiving section which is provided so as to face the staple inserting section across a sheet bundle accumulated on the accumulating section; and a movement section which moves an inserting unit or the accumulating section according to a thickness of the sheet bundle so that the inserting unit faces a predetermined position on an upmost sheet of the sheet bundle, wherein the staple inserting section includes the inserting unit which inserts a staple into the sheet bundle by rotating toward the sheet bundle.

5 Claims, 12 Drawing Sheets

(56) References Cited

U.S. PATENT DOCUMENTS

| | | | | |
|---|---|---|---|---|
| 8,191,884 | B2 * | 6/2012 | Sato et al. | 270/58.08 |
| 2007/0278732 | A1 | 12/2007 | Kitahara | |
| 2010/0252983 | A1 | 10/2010 | Sugihara | |

FOREIGN PATENT DOCUMENTS

| | | | |
|---|---|---|---|
| JP | 09-216764 | | 8/1997 |
| JP | 2005-041661 | A | 2/2005 |
| JP | 2009208855 | A | 9/2009 |
| JP | 2011190075 | A | 9/2011 |
| JP | 2012-180151 | A | 9/2012 |

OTHER PUBLICATIONS

Office Action dated Apr. 20, 2015 for the corresponding Japanese Patent Application No. 2013-139588 (2 pages).

English translation of Office Action dated Apr. 20, 2015 for the corresponding Japanese Patent Application No. 2013-139588 (5 pages).

Office Action dated Sep. 18, 2015 issued from the corresponding Chinese Patent Application No. 201410315777.7.

English translation of Office Action dated Sep. 18, 2015 issued from the corresponding Chinese Patent Application No. 201410315777.7.

* cited by examiner

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

There are known some conventional sheet processing apparatuses each of which forms a booklet with a saddle stitching section including a saddle unit to sequentially accumulate sheets of paper that are mountain-folded along middle folding lines so as to straddle the saddle unit, a staple inserting unit to insert a staple from above into the folding lines of the sheets accumulated on the saddle unit and a staple receiving unit which is provided to face the staple inserting unit across the sheets and receives and bends the ends of the staples inserted by the staple inserting unit (for example, see Japanese Patent Application Laid Open Publication No. 2005-41661).

In Japanese Patent Application Laid Open Publication No. 2005-41661, the staple receiving unit is built in the saddle unit and configured to protrude upward from the top of the saddle unit when the staple inserting unit puts a staple through a sheet.

However, such configuration has a problem that the staple receiving unit is moved upward less stably when a larger number of sheets are accumulated and thus the staple is inserted at a less accurate position.

Against the above problem, there has been suggested a configuration in which the staple receiving unit is fixed inside the saddle unit, the top of the staple receiving unit is located at the top of the saddle unit and the staple inserting unit moves so as to make an arc (hereinafter, called are motion) toward the saddle unit and the staple receiving unit (for example, see Japanese Patent Application Laid Open Publication No. H9-216764).

Such staple inserting unit which makes an arc motion is also used for side stitching processing to put staples into unfolded sheets.

However, since the staple inserting unit makes an are motion, as shown in FIG. 13, the above Japanese Patent Application Laid Open Publication No. H9-216764 has a problem that the staple inserting unit D makes the arc motion with the orbit out of the ridge line at the top of the upmost sheet in the sheet bundle depending on the thickness of the sheet bundle accumulated on the saddle unit K, and thus the staple is inserted at a position (stapling position) shifted from the folding line on the upmost sheet, that is, a desired position.

Such problem also possibly occurs in the side stitching processing.

SUMMARY OF THE INVENTION

The present invention has been made in consideration of the above problems in conventional techniques, and an object of the present invention is to provide a sheet processing apparatus and an image forming system which enables accurate stapling at a desired position regardless of the thickness of the accumulated sheet bundle.

In order to achieve the above object, according to one aspect of the present invention, there is provided a sheet processing apparatus including: an accumulating section on which a sheet is accumulated; a staple inserting section which is provided above the accumulating section; a staple receiving section which is provided so as to face the staple inserting section across a sheet bundle accumulated on the accumulating section; and a movement section which moves an inserting unit or the accumulating section according to a thickness of the sheet bundle so that the inserting unit faces a predetermined position on an upmost sheet of the sheet bundle, wherein the staple inserting section includes the inserting unit which inserts a staple into the sheet bundle by rotating toward the sheet bundle.

Preferably, in the sheet processing apparatus, the accumulating section includes a saddle unit on which a mountain-folded sheet folded along a folding line at a middle portion is accumulated so as to straddle the saddle unit, the staple receiving section is fixed inside the saddle unit so as to locate an upper part thereof at a top of the saddle unit, and the movement section moves the inserting unit or the saddle unit in a direction orthogonal to the folding line along a horizontal plane according to the thickness of the sheet bundle so that the inserting unit faces the folding line on the upmost sheet of the sheet bundle accumulated on the saddle unit.

Preferably, the sheet processing apparatus further includes a storage section in which movement information regarding the thickness of the sheet bundle and a movement amount of the inserting unit or the accumulating section is stored, and the movement section determines the movement amount of the inserting unit or the accumulating section on a basis of the movement information stored in the storage section.

Preferably, in the sheet processing apparatus, the inserting unit includes a biasing member which biases the inserting unit toward a base end portion thereof, and the movement section includes: a drive motor; a shaft member which is rotated by the drive motor; an eccentric cam which is connected to the shaft member; a push-out member which is provided so as to abut with the base end portion of the inserting unit and moves toward or away from the inserting unit in accordance with rotation of the eccentric cam; and a control unit which drives the drive motor.

Preferably, in the sheet processing apparatus, a supporting unit extending along a direction orthogonal to a movement direction of the inserting unit is provided near the inserting unit, the inserting unit includes: a main body which is rotated toward the sheet bundle; and a cover which is provided above the main body, and the cover includes a protruding portion which abuts with the supporting unit.

Preferably, in the sheet processing apparatus, an initial position of the inserting unit is set to a position thereof when the sheet bundle accumulated on the accumulating section has a largest thickness.

According to another aspect of the present invention, there is provided an image forming system, includes an image forming apparatus which forms an image on a sheet; and the sheet processing apparatus according to claim 1 which is connected to the image forming apparatus and performs saddle stitching that is stapling, along a middle folding line, the sheet having the image formed by the image forming apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

An image forming system 1 according to an embodiment of the present invention will now be described with reference to the drawings.

Figure 1:
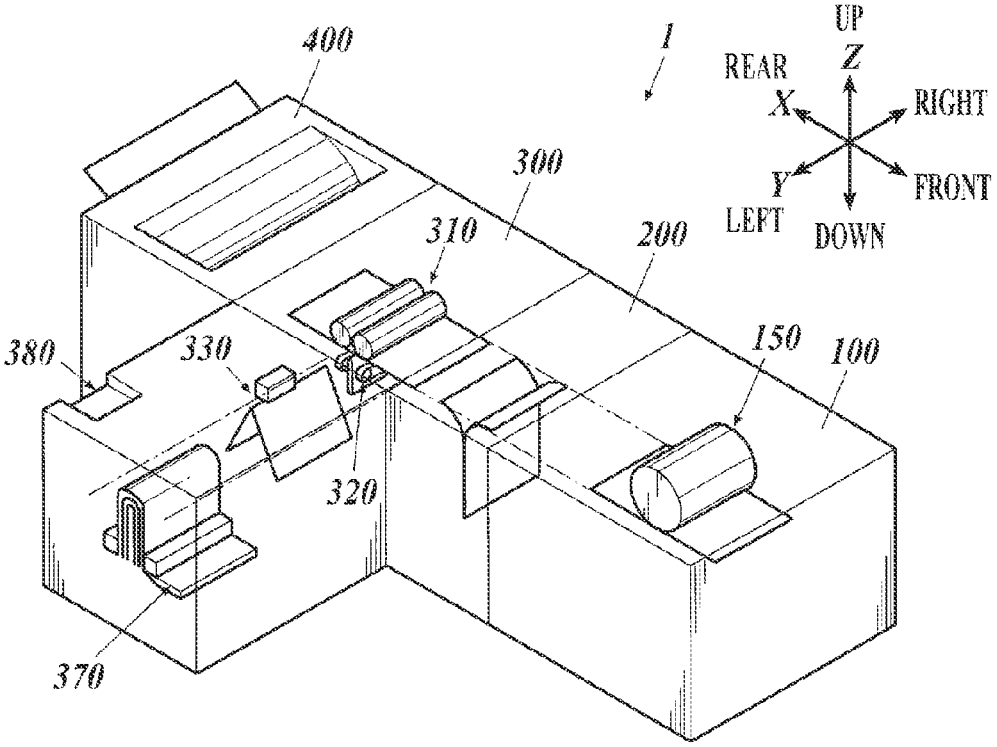
FIG. 1 is a schematic view illustrating the entire configuration of an image forming system.

FIG. 1 is a schematic view illustrating the entire configuration of the image forming system 1.

The image forming system 1 includes an image forming apparatus 100, an intermediate conveyance apparatus 200, a saddle stitching apparatus 300 and a side stitching apparatus 400.

In the following description, the vertical direction referred to as Z direction; the direction of an array of the image forming apparatus 100, the intermediate conveyance apparatus 200, the saddle stitching apparatus 300 and the side stitching apparatus 400 in FIG. 1 is referred to as X direction; and the direction orthogonal to both the X and Z directions is referred to as Y direction.

The X direction has front and rear sides and the Y direction has right and left sides. The front side is upstream and the rear side is downstream when a sheet is conveyed in the image forming system 1. The right side is upstream and the left side is downstream when a sheet is conveyed in half folding and saddle stitching processing by the saddle stitching apparatus 300.

The image forming apparatus 100 forms an image on a sheet of paper.

In specific, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as transfer roller, a first transfer section to transfer the toner image developed on the first transfer member onto a second transfer member such as transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet which has the image formed thereon to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can temporarily stack a sheet and score and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface along the Z direction; an alignment section which aligns the position of the sheet during standby; a scoring section (creaser) which scores the aligned sheet; and a trimming section (slitter) which trims off margins in the sheet while the conveyance of the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the trimming section while conveying the scored sheet. Then, the intermediate conveyance apparatus 200 passes the sheet with the margins trimmed off by the trimming section to the saddle stitching apparatus 300.

The intermediate conveyance apparatus 200 can also pass the sheet received from the image forming apparatus 100 to the saddle stitching apparatus 300 without performing a part or all of the various processes by the intermediate conveyance apparatus 200.

The saddle stitching apparatus 300 as a sheet processing apparatus performs half folding that is folding the sheet in half (in two), saddle stitching that is stapling a predetermined number of stacked half-folded sheets to create a saddle-stitched booklet, trimming that is trimming the end surfaces of the saddle-stitched booklet, and such like.

In specific, the saddle stitching apparatus 300 includes, for example, a half folding section 310 which folds the sheet received from the intermediate conveyance apparatus 200 in half along the Y direction, a conveyance mechanism 320 which conveys the sheet half-folded by the half folding section 310 in the direction (Y direction) along the folding line in the sheet, a saddle stitching section 330 which inserts staples into the sheet bundle to perform saddle stitching after overlying sheets conveyed from the conveyance mechanism 320, a trimming section 370 which trims the end surfaces of the saddle-stitched sheet bundle, and an ejecting section 380 which ejects the saddle-stitched booklet having the trimmed end surfaces.

The saddle stitching apparatus 300 can also pass the sheet received from the intermediate conveyance apparatus 200 to the side stitching apparatus 400 without performing a part or all of the various processes by the saddle stitching apparatus 300. The saddle stitching apparatus 300 may further include a processing section for square folding to form the spine of the saddle-stitched booklet.

Figure 2:
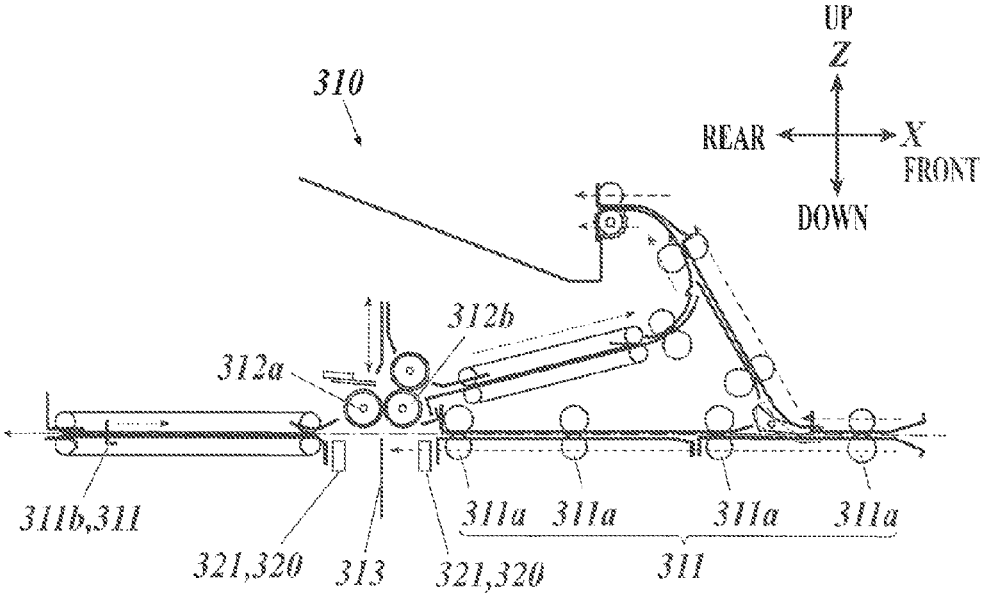
FIG. 2 is a schematic view illustrating a configuration of a half folding section in a sheet processing apparatus as an example.

FIG. 2 is a schematic view illustrating the configuration of the half folding section 310 as an example.

The half folding section 310 includes, for example, a conveyance unit 311 which conveys the sheet received from the image forming apparatus 100 to a predetermined position, a pair of half folding rollers 312*a* and 312*b* which is located above the sheet stopped at the predetermined position and a plate-like folding knife 313 which is located below the pair of half folding rollers 312*a* and 312*b* and movable so as to come between the half folding rollers 312*an* and 312*b*.

The conveyance unit 311 conveys the sheet received from the image forming apparatus 100 downstream with the sheet surface in nearly parallel to the X-Y plane by a plurality of pairs of conveyance rollers 311*a*, and locks the end at downstream side in conveyance direction of the conveyed sheet to locate and stop the sheet at a predetermined position with a stopper 311*b* provided on the conveyance path.

The predetermined position is a position where the central portion in the X direction of the conveyed sheet face the folding knife 313. In order to stop the sheet at such predetermined position, on, the position of the stopper 311*b* on the conveyance path is appropriately set according to the sheet size.

The half folding rollers 312*a* and 312*b* are cylindrical rollers provided to be rotatable and function as a nip unit along the Y direction by contacting each other at the outer circumferential surfaces.

The folding knife 313 is a plate like member provided along Y-Z plane. When the sheet is located between the pair of half folding rollers 312*a* and 312*b* and the folding knife 313, the folding knife 313 comes between the half folding rollers 312*a* and 312*b*, and thereby presses the sheet into the nip unit. Thus, the sheet is folded in two so as to have a folding line along the Y direction at the position contacting the folding knife 313. That is, the sheet is in what is called a mountain fold shape with the folding line up and the both ends down.

In such half folding process, a sheet may be folded one by one or every plurality of sheets may be folded (for example, every three sheets).

Figure 3:
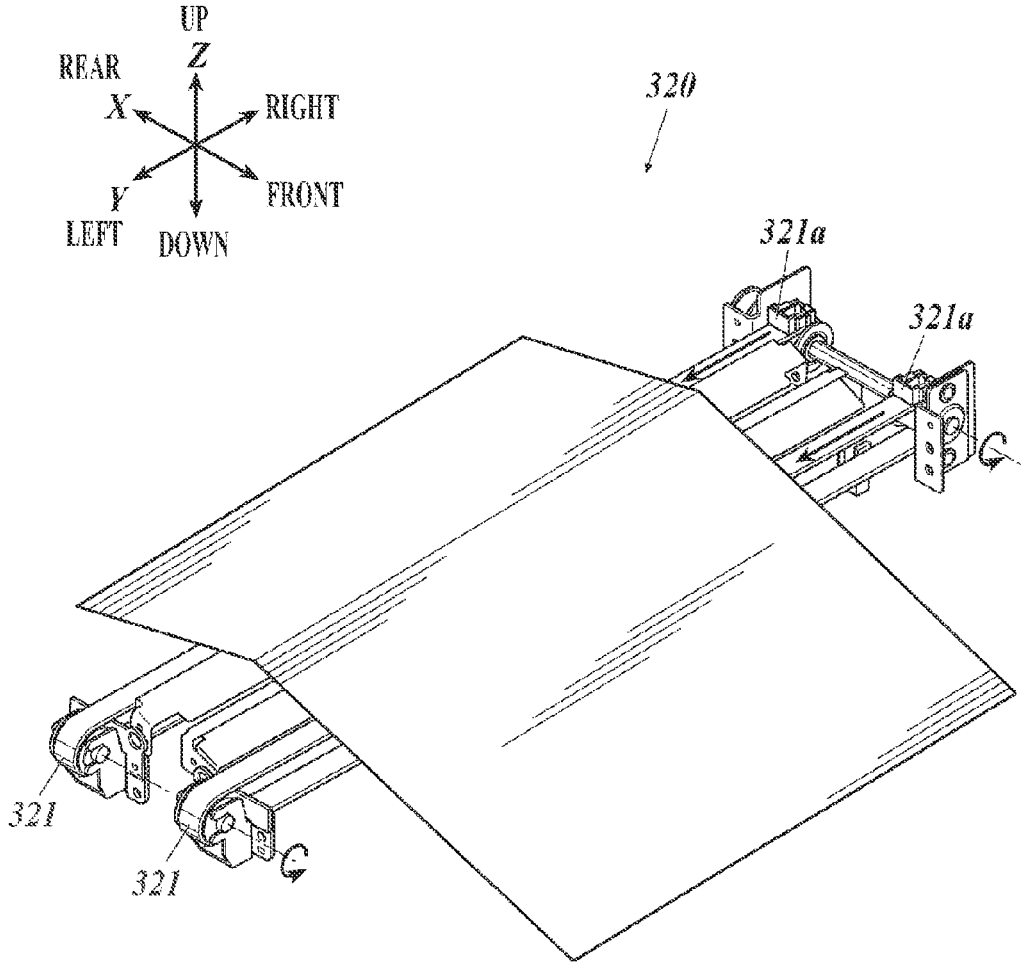
FIG. 3 is a perspective view illustrating a configuration of a conveyance mechanism in the sheet processing apparatus as an example.

FIG. 3 is a perspective view illustrating the configuration of the conveyance mechanism 320 as an example.

The conveyance mechanism 320 includes two conveyance belts 321 and 321, for example.

The two conveyance belts 321 and 321 are disposed so as to extend in the Y direction sandwiching the folding knife therebetween as shown in FIGS. 2 and 3, and conveys the half-folded sheet in the direction (Y direction) along the folding line.

The two conveyance belts 321 and 321 start rotating after the sheet is folded in two by the folding knife 313 moving up and down in the Z direction.

Abutting portions 321*a* and 321*a* are fixed on the respective conveyance belts 321 and 321 so as to protrude from their surfaces. The abutting portions 321*a* and 321*a* on the conveyance belts 321 and 321 move according to the rotation of the conveyance belts 321 and 321 to abut with the back end in conveyance direction (right end) of the half-folded sheet, push the abutting sheet to the accumulating section 340 and thereafter return to the initial position not abutting the back end in conveyance direction of the sheet.

The half-folded sheet is conveyed to the after-mentioned accumulating section 340 in the saddle stitching section 330 by such conveyance mechanism 320.

Figure 4:
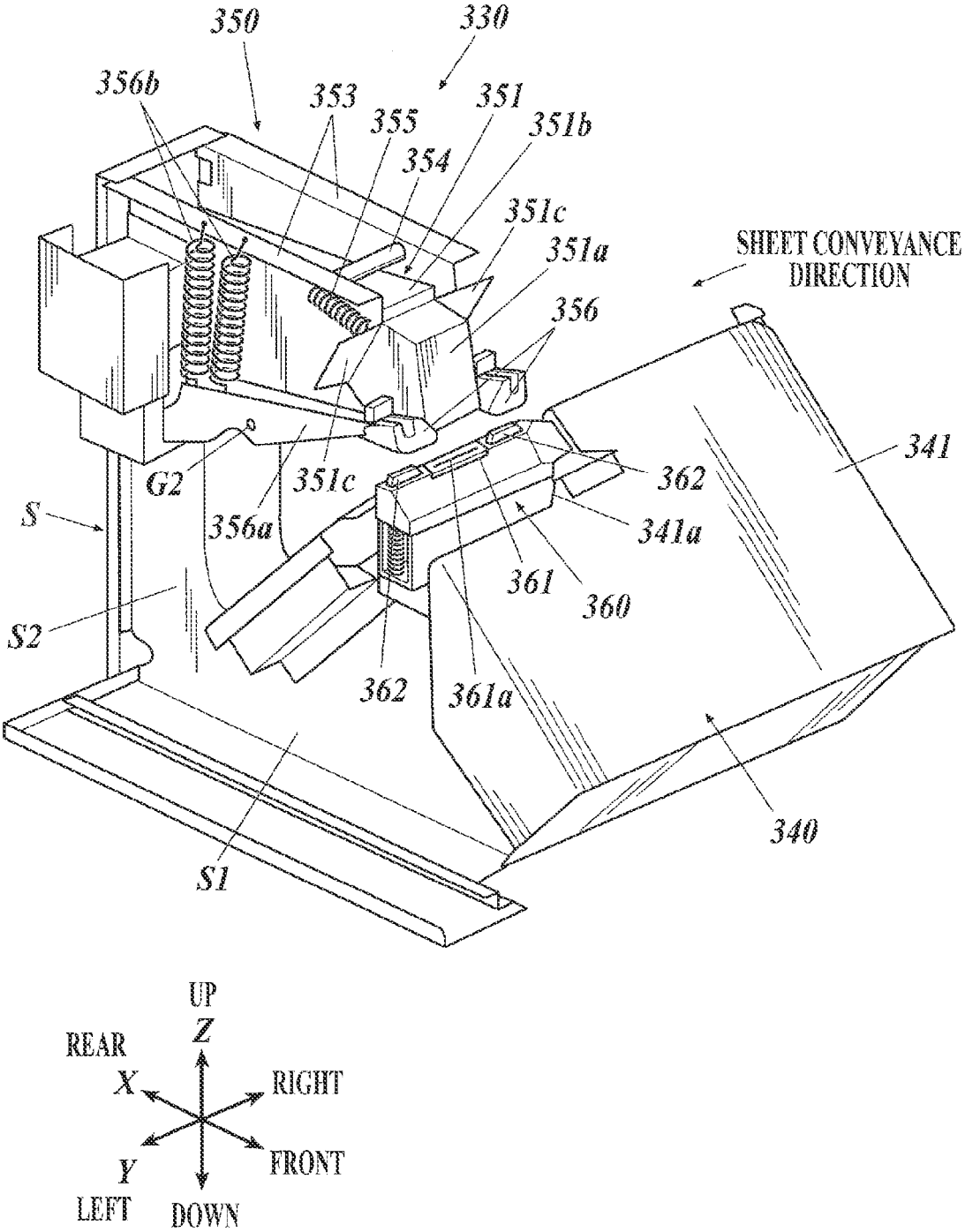
FIG. 4 is a perspective view illustrating a configuration of a saddle stitching section in the sheet processing apparatus as an example.

FIG. 4 is a perspective view illustrating the configuration of the saddle stitching section 330 as an example.

The saddle stitching section 330 includes an accumulating section 340 to overlie and accumulate sheets conveyed by the conveyance mechanism 320, a staple inserting section 350 provided above the accumulating section 340, a staple receiving section 360 provided inside the accumulating section 340 and a supporting section S to support the sections.

The supporting section S includes a base portion S1 extending in the X direction and a standing portion S2 provided to be vertical from a base end of the base portion S1. The accumulating section 340 and the staple receiving section 360 are provided at the front end of the base portion S1 and the staple inserting section 350 is provided at the upper end of the standing portion S2.

The accumulating section 340 is provided next to the left end of the conveyance mechanism 320.

The accumulating section 340 includes a saddle unit 341 to place the sheets conveyed by the conveyance mechanism 320, for example.

The saddle unit 341 is in a convex shape with the top part at an angle of nearly 90 degrees, and mountain-folded sheets (mountain-shape sheets) which have been conveyed by the conveyance mechanism 320 are placed on the top part of the saddle unit 341 so as to straddle the saddle unit 341.

When each of the sheets to form a booklet is half-folded, the sheet is ejected and sequentially placed on the saddle unit 341 so that the sheet which is innermost of the booklet to be formed is located lowest.

A cut-out portion 341*a* to expose the top part of the staple receiving section 360 fixed inside the saddle unit 341 is formed at the left end of the top part of the saddle unit 341, and the upper portion of the staple receiving section 360 is located at the top of the saddle unit 341.

Though not shown in the drawings, a front end alignment unit which abuts with the front end in conveyance direction of the sheet advancing from right to left on the saddle unit 341 and stops the sheet is provided downstream of the saddle unit 341 in the sheet conveyance direction.

It is also preferable that a back end alignment unit movable in the Y direction along the top ridge line of the saddle unit 341 is provided at the right end of the top part of the saddle unit 341. When the sheet is placed on the saddle unit 341, the back end alignment unit lightly hits the back end in conveyance direction of the sheet by reciprocating in the Y direction along the top part ridge line of the saddle unit 341 to align the sheet in the conveyance direction.

Figure 5:
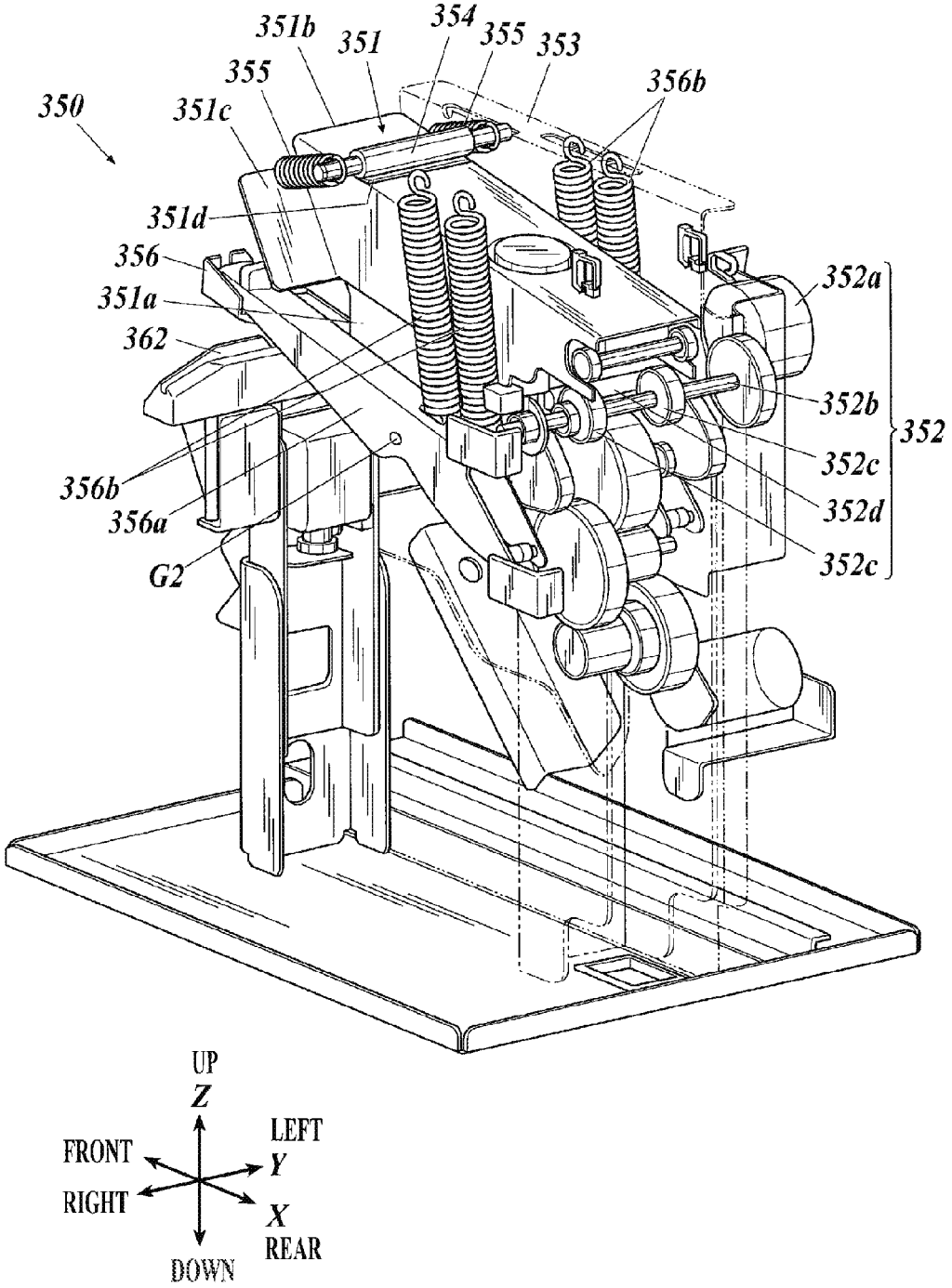
FIG. 5 is a perspective view of a staple inserting section seen from the right rear.
Figure 6:
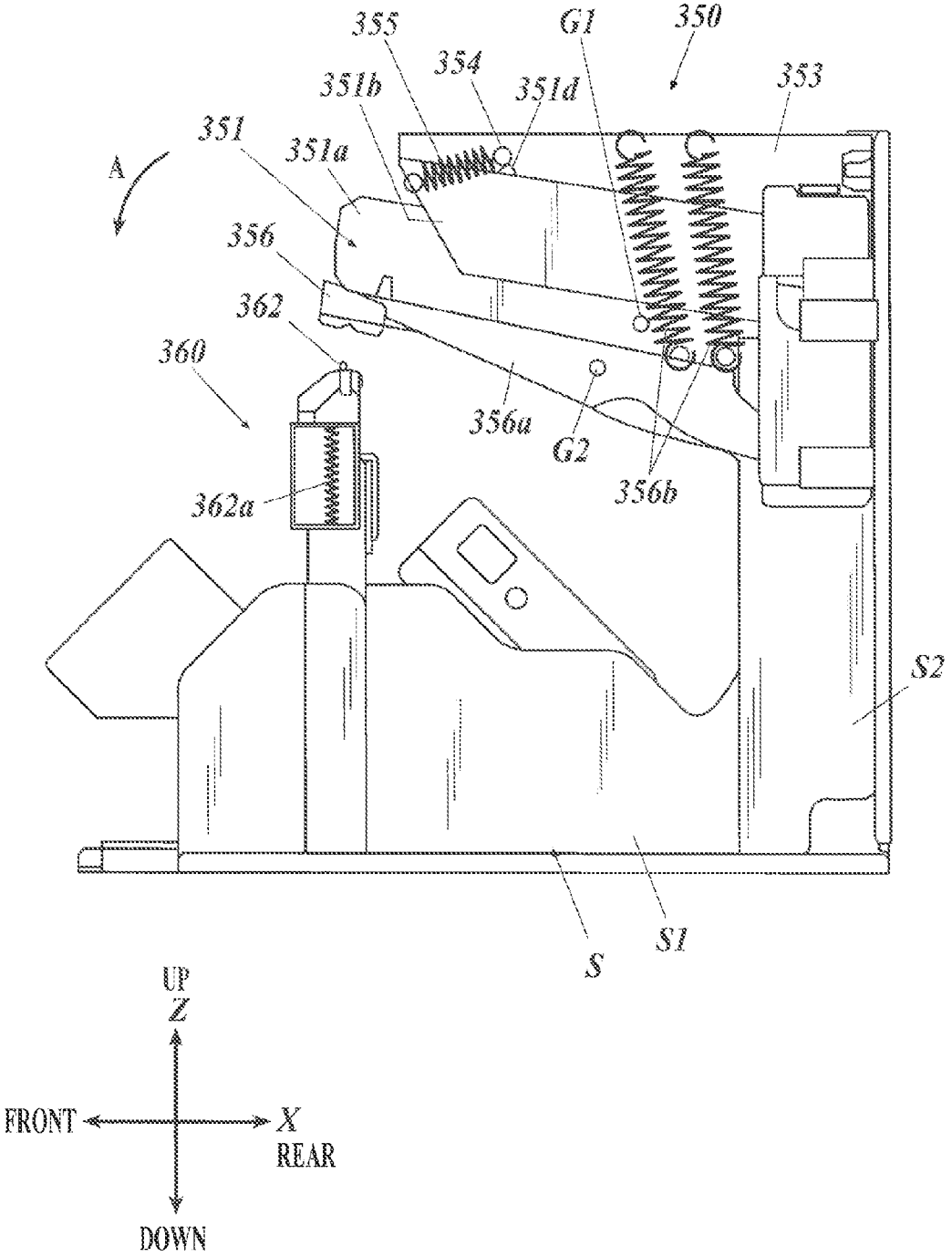
FIG. 6 is a lateral view of the staple inserting section seen from the right.
Figure 7:
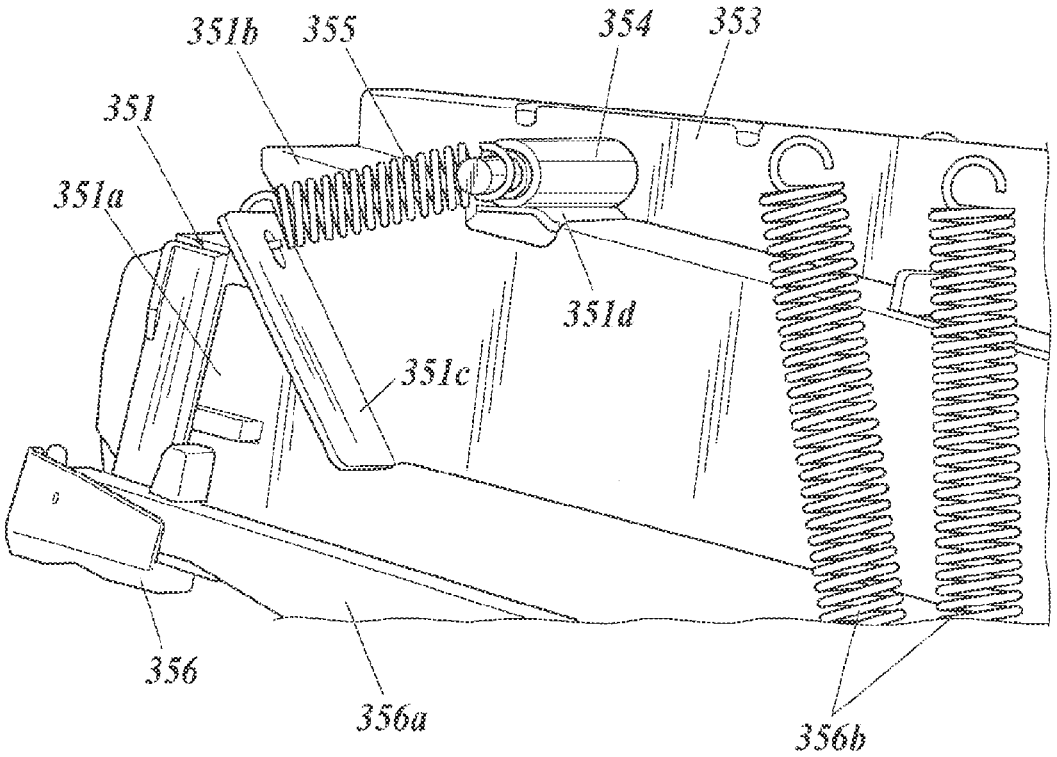
FIG. 7 is an enlarged view illustrating a front end portion of the staple inserting section.
Figure 7:
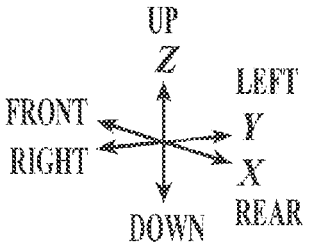
Figure 8:
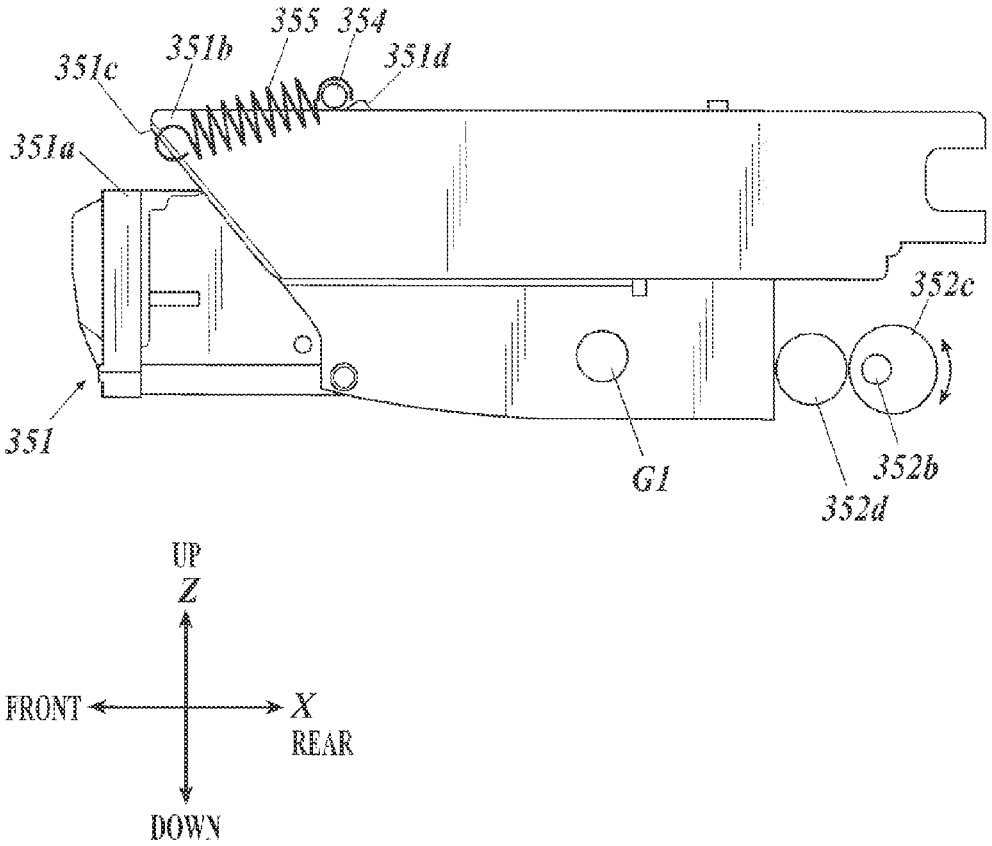
FIG. 8 is a schematic view illustrating an inserting unit in the staple inserting section.

FIG. 5 is a perspective view of the staple inserting section 350 seen from the right rear. FIG. 6 is a lateral view of the staple inserting section 350 in FIG. 5 seen from the right FIG. 7 is an enlarged view illustrating the front end of the staple inserting section 350. FIG. 8 is a schematic view illustrating an inserting unit 351 in the staple inserting section 350.

In FIGS. 5 to 7, the illustration of right lateral wall 353 in the inserting unit 351 is omitted.

The staple inserting section 350 includes an inserting unit 351 to put a staple into the sheets placed on the saddle unit 341, for example.

The inserting unit 351 includes a main body 351*a* containing staples and a cover 351*b* covering the top part of the main body 351*a*, and the rear end of the inserting unit 351 is supported by the standing portion S2.

The main body 351*a* and the cover 351*b* move in the X direction in an integrated manner, and when inserting a staple, only the main body 351*a* is rotated.

A drive mechanism 352 to drive the inserting unit 351 in the X direction is provided at the rear side of the inserting unit 351.

Lateral walls 353 and 353 are respectively provided at the left and right sides of the inserting unit 351.

A supporting unit 354 supported by the lateral walls 353 and 353 at the ends thereof is provided in the front side above the inserting unit 351 so as to extend along the Y direction.

The main body 351*a* includes a feeding port (not shown in the drawings) at the lower surface of the front end, and feeds a staple through the feeding port when abutting with the sheet.

Specifically, the main body 351*a* is driven by a drive motor M1 (see FIG. 10) to rotate in the arrow A direction in FIG. 6 around a rotation shaft G1.

Extending plates 351*c* and 351*c* extending laterally from the respective lateral surfaces are provided at the front part of the cover 352*b*, and the extending plates 351*c* and 351*c* respectively include biasing members 355 and 355 which bias the inserting unit 351 backward.

The biasing members 355 and 355 are pull-type coil springs, for example, and bias the inserting unit 351 backward in a state in which the front ends thereof are connected to the top parts of the respective extending plates 351*c* and 351*c* and the rear ends thereof are connected to the supporting unit 354.

A protruding portion 351*d* protruding upward is provided on the upper surface of the cover 351*b*, and the protruding portion 351*d* is maintained abutting with the rear end of the lower part in the supporting unit 354.

The protruding portion 351*d* functions as a stopper for preventing the cover 351*b* and the inserting unit 351 from plunging forward due to the impulse when the main body 351*a* is rotated around the rotation shaft G1 to provide a staple.

The drive mechanism 352 includes a drive motor 352*a*, a shaft 352*b* which is rotated by the drive motor 352*a*, eccentric cams 352*c* connected to the shaft 352*b* and a push-out member 352*d* abutting with the rear side of the main body 351*a*, for example. The drive mechanism 352 functions as a movement section together with a saddle stitching control section 505 (described later).

The drive motor 352*a* is a pulse motor such as step motor, for example, and by the control of the saddle stitching control section 505, drives a rotor to make a step movement forward or backward by a predetermined angle. Thus, a rotation drive force is provided to a drive force transmitting section not shown in the drawings, and the drive force transmitting section rotates the shaft 352*b*.

The shaft 352*b* is provided at the rear side of the inserting unit 351 (main body 351*a*) so as to extend in the Y direction. The shaft 352*b* is rotated according to the drive of the drive motor 352*a*. The shaft 352*b* includes two eccentric cams 352*c*.

Each of the eccentric cams 352*c* is formed in a nearly circle shape, and the shaft 352*b* penetrates positions slightly shifted from the centers of the eccentric cams 352*c*. The eccentric cams 352*c* are rotated forward or backward by a predetermined angle by the shaft 352*b* being rotated according to the drive of the drive motor 352*a*.

The push-out member 352*d* abuts with the eccentric cams 352*c*. The push-out member 352*d* is, for example, supported by a shaft receiver (not shown in the drawings) with a long hole extending in the X direction, and can move in the X direction.

The push-out member 352*d* moves forward by the eccentric cams 352*c* being rotated forward by the predetermined angle. Thus, the main body 351*a* and the inserting unit 351 move forward against the biasing force by the biasing members 355 and 355.

The push-out member 352*d* moves backward by the eccentric cams 352*c* being rotated backward by the predetermined angle. Then, the main body 351*a* and the inserting unit 351 move backward by the biasing force of the biasing members 355 and 355.

The staple inserting section 350 is provided with two pressing members 356 and 356 along the Y direction so as to sandwich the inserting unit 351 therebetween. The pressing members 356 and 356 are disposed at positions facing the supporting members 362 and 362 provided at the staple receiving section 360.

When a predetermined number of sheets for a single booklet are placed on the saddle unit 341, by the drive of a drive motor M2 (see FIG. 10), arms 356*a* are rotated in the arrow A direction of FIG. 6 around the rotation shaft G2 to lower the pressing members 356 and 356 so that the pressing members 356 and 356 can press the sheets on die saddle unit 341 with the supporting members 362 and 362.

Specifically, the biasing members 356 and 356 have a configuration that the rear ends of the arms 356*a* are biased upward by biasing members 356*b* such as pull-type coil springs and pressed downward by a cam mechanism not shown in the drawings or such like. When the predetermined number of sheets are placed on the saddle unit 341, the press by the cam mechanism is released by the drive of the drive motor M2, and the rear ends of the arms 356*a* are pulled up to lower the front ends thereof.

After the pressing members 356 and 356 are lowered to press the sheets on the saddle unit 341 with the supporting members 362 and 362 in such way, the inserting unit 351 provides staples.

Figure 9:
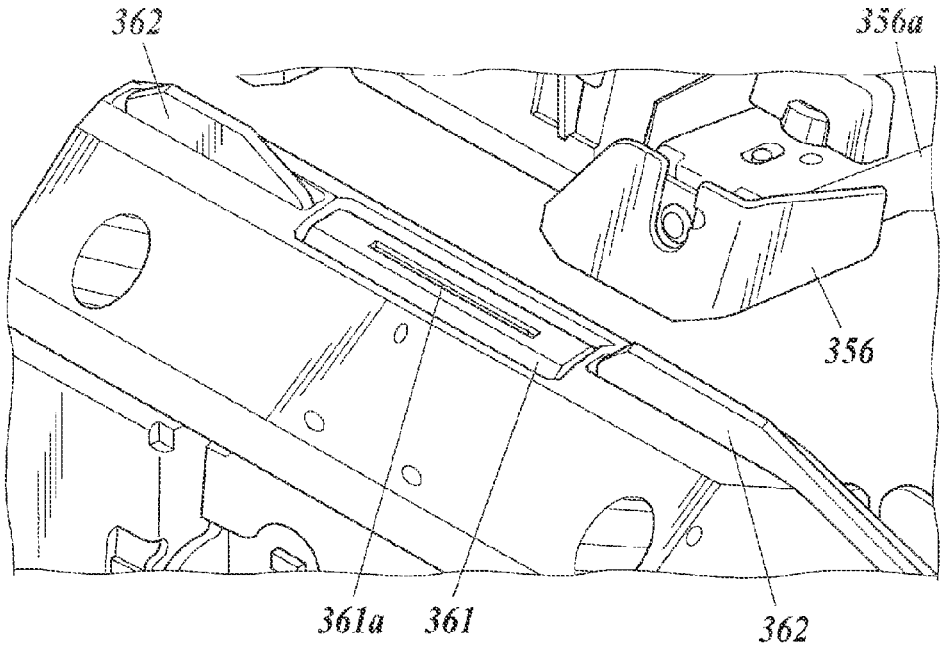
FIG. 9 is an enlarged view illustrating a receiving unit in a staple receiving section.
Figure 9:
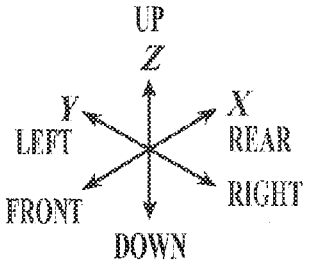

FIG. 9 is an enlarged view illustrating a receiving unit 361 in the staple receiving section 360.

The staple receiving section 360 includes a receiving unit 361 provided inside the saddle unit 341 and two supporting members 362 and 362 disposed along the Y direction across the receiving unit 361.

The receiving unit 361 is fixed inside the saddle unit 341, and the top part thereof is exposed through the cut-out portion 341*a* in the saddle unit 341. A concave portion 361*a* for abutting and bending the ends of the staple inserted by the inserting unit 351 is formed on the upper surface of the receiving unit 361. That is, the ends of the staple pressed against, the sheets to penetrate the sheets by the inserting unit 351 are bent by abutting with the concave portion 361*a*.

Here, the width in the X direction of the concave portion 361*a* is set to be 2.3 mm, for example.

Generally, the width in the X direction of the concave portion 361*a* is approximately 0.2 mm which is slightly larger than the width of the staple; however, the embodiment sets a larger width in the X direction of the concave portion 361*a* since the inserting unit 351 moves in the X direction. Thus the ends of the staple can surely abut with the concave portion 361*a*.

Though the width in the X direction of the concave portion 361*a* is set to be 2.3 mm in the embodiment for the above reason, the width in the X direction of the concave portion 361*a* can be appropriately changed as long as it is larger than 0.2 mm and equal to or less than 2.3 mm. By setting the width in the X direction of the concave portion 361*a* equal to or less than 2.3 mm, staple buckling can be prevented.

The supporting members 362 and 362 are provided along the Y direction across the receiving unit 361. The supporting members 362 and 362 are provided at positions facing the pressing members 356 and 356 in the staple inserting section 350, and sandwich the sheets with the pressing members 356 and 356 when the pressing members 356 and 356 are lowered.

Specifically, the upper ends of the supporting members 362 and 362 protrude from the upper surface of the receiving unit 361, and the supporting members 362 and 362 are supported by the spring members 362*a* biasing the supporting members 362 and 362 so as to protrude upward. When the pressing members 356 and 356 are lowered, the supporting members 362 and 362 are withdrawn downward by the press from the pressing members 356 and 356.

Thus, the supporting members 362 and 362 can press the top part ridge line of the sheets to be flat with the pressing members 356 and 356, and nearly flatten the folding line in the top part of the sheets to be stapled by the inserting unit 351.

The trimming section 370 trims the end surfaces of the booklet which has been saddle-stitched as described above. That is, the trimming section 370 performs trimming to align the end surfaces since the end surfaces of such saddle-stitched booklet are not aligned depending on the number of sheets forming the booklet.

The electing section 380 ejects the booklet having the end surfaces trimmed by the trimming section 370.

Returning to FIG. 1, the side stitching apparatus 400 performs side stitching to a plurality of sheets.

Specifically, the side stitching apparatus 400 includes, for example, a stapling section to staple a plurality of sheets received from the saddle stitching apparatus 300, a page end trimming section to trim a part of end portions of the plurality of stapled sheets so as to align the end portions which are parallel to the spine, and an ejecting section to eject the sheets which have been processed by the connected apparatuses.

The side stitching apparatus 400 can eject the sheets received from the saddle stitching apparatus 300 without performing a part or all of the various processes by the side stitching apparatus 400.

Next, the operation control of the image forming system 1 will be described.

Figure 10:
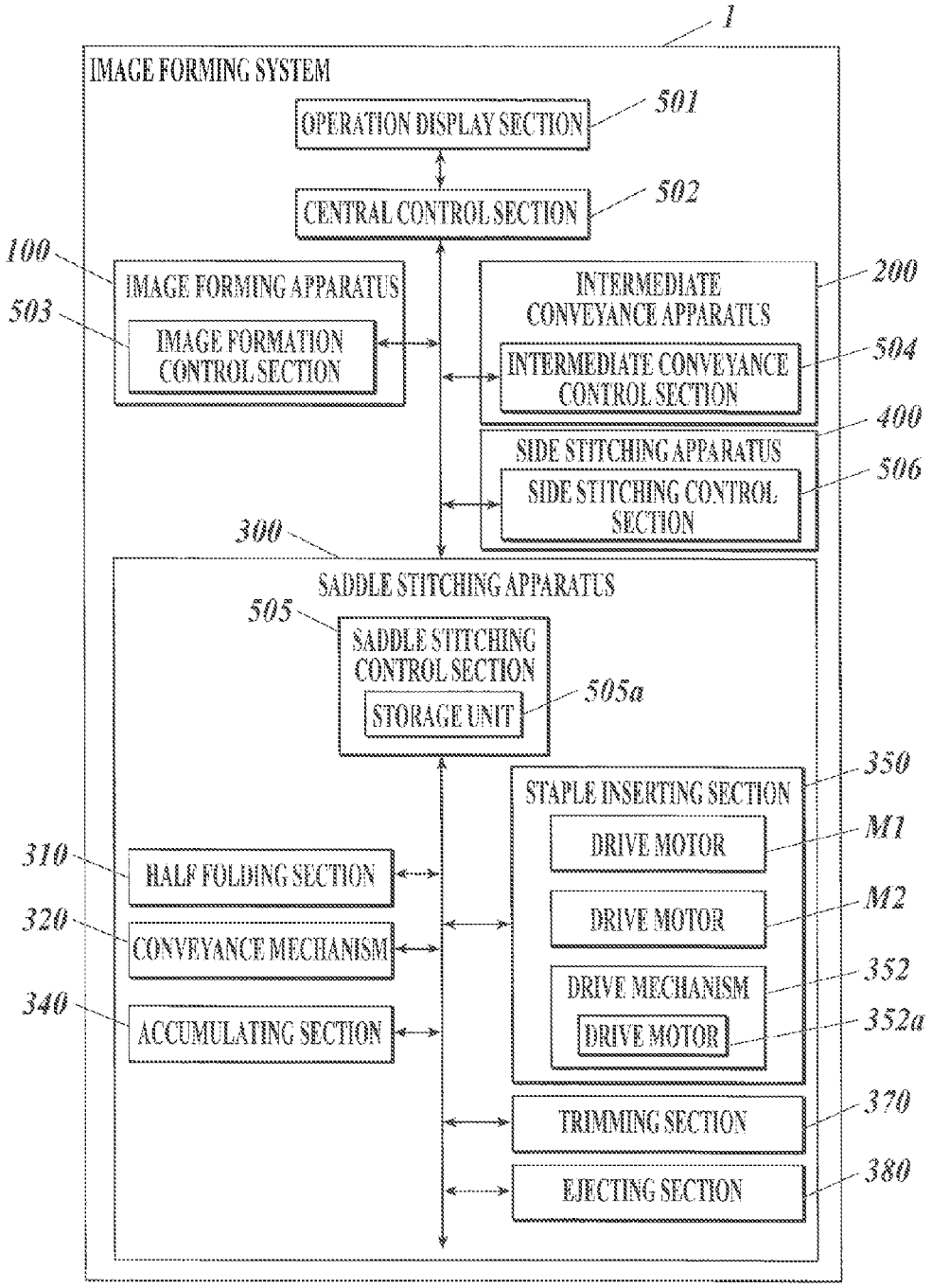
FIG. 10 is a block diagram showing a main configuration according to the operation control of the image forming system.

FIG. 10 is a block diagram showing the main configuration according to the operation control in the image forming system 1.

The image forming system 1 includes an operation display section 501 which receives input operation from a user according to the operation of the image forming system 1 and performs display according to the operation of the image forming system 1, a central control section 502 which controls operations of the entire image forming system 1, an image formation control section 503 which controls operations of the image forming apparatus 100, an intermediate conveyance control section 504 which controls operations of the intermediate conveyance apparatus 200, a saddle stitching control section 505 which controls operations of the saddle stitching apparatus 300 and a side stitching control section 506 which controls operations of the side stitching apparatus 400.

The operation display section 501 includes, for example, a touch panel type operation display unit or switches and keys for various types of input to send a signal according to the input from the user to the central control section 502.

Each of the central control section 502, the image formation control section 503, the intermediate conveyance control section 504 and the side stitching control section 506 includes a CPU (Central Processing Unit), a RAM (Random Access Memory), a storage unit and such like to read out a software program and various types of data according to processing and execute the processing.

Similarly, the saddle stitching control section 505 also includes a CPU, a RAM, a storage unit 505*a* and such like to read out a software program and various types of data according to processing and execute the processing.

The storage unit 505*a* is a non-volatile memory which is readable and writable.

In response to the input from the user via the operation display section 501, the central control section 502 sets various types of conditions according to the image forming system 1 such as sheet size and the number of colors to form images (for example, full-color, gray scale or monochrome), the number of sheets in a single booklet to be saddle-stitched, whether to trim the end portions which are margins, the width of the end portions to be trimmed and nip pressure in the half folding processing. Then, the central control section 502 outputs instructions to perform the processing according to the setting to the image formation control section 503, the intermediate conveyance control section 504, the saddle stitching control section 505 and the side stitching control section 506. The control sections control operations of the respective apparatuses to be controlled according to the instructions.

For example, the central control section 502 outputs an instruction for performing half folding and saddle stitching to the saddle stitching control section 505.

In response to this, the saddle stitching control section 505 controls the half folding section 310 to perform half folding and controls the saddle stitching section 330 to perform saddle stitching.

The saddle stitching is executed according to the setting condition set by the user operating the operation display section 501. The setting condition includes, for example, the number and position of staples to be put into the sheets along the folding line in addition to the type, basis weight and the number of sheets to be saddle stitched.

The saddle stitching control section 505 determines the movement amount of the inserting unit 351 when performing saddle stitching on the basis of the thickness of a sheet bundle according to the setting condition.

At this time, the saddle stitching control section 505 refers to the storage unit 505*a*.

As movement information, a table associating the thickness of the sheet bundle accumulated on the saddle unit 341 with the movement amount of the inserting unit 351 is stored in the storage unit 505*a*, for example.

The saddle stitching control section 505 calculates the thickness of the sheet bundle according to the setting condition (type, basis weight and the number of sheets) and refers to the table stored in the storage unit 505*a* to determine the movement amount of the inserting unit 351 according to the thickness of the sheet bundle.

The movement amount is a distance that the inserting unit 351 moves from a predetermined reference position. The movement amount is indicated with a positive numeral value when the inserting unit 351 moves forward from the predetermined reference position and indicated with a negative numeral value when the inserting unit 351 moves backward from the predetermined reference position, for example.

The position where the inserting unit 351 is to be located when the sheet bundle has the largest thickness is used as the predetermined reference position, for example.

The position of the inserting unit 351 as initial setting is set according to the largest thickness of the sheet bundle. That is, as initial setting, the inserting unit 351 is located at the position where the staple can penetrate straight through the sheet bundle and have the largest inserting force when the sheet bundle has the largest thickness.

Such initial setting enables the inserting unit 351 move for a smaller distance when the sheet bundle has a larger thickness, makes the position setting harder to shift, and thus can reduce the concern of staple buckling.

An arithmetic expression for calculating the movement amount of the inserting unit from the sheet type, basis weight and the number of sheets may be stored in advance as the movement information in addition to the table.

Next, operations of the staple inserting section 350 in the saddle stitching by the saddle stitching apparatus 300 will be described.

Figure 11:
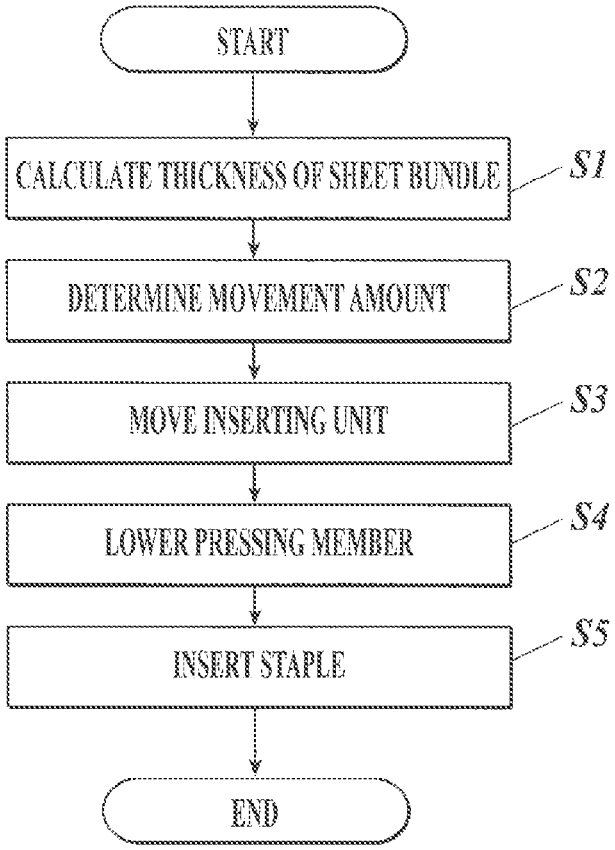
FIG. 11 is a flowchart showing operations of the staple inserting section in saddle stitching processing.

FIG. 11 is a flowchart showing operations of the staple inserting section 350 in the saddle stitching.

Before starting the saddle stitching, the saddle stitching control section 505 sequentially half-folds the predetermined number of sheets to form a booklet with the half folding section 310, and sequentially conveys the half-folded sheets onto the saddle unit 341 in the accumulating section 340 with the conveyance mechanism 320.

When the sheets are conveyed onto the saddle unit 341 in the accumulating section 340, the saddle stitching control section 505 controls so that the staple inserting section 350 is located away from the accumulating section 340 and the staple receiving section 360.

The saddle stitching control section 505 first calculates the thickness of the sheet bundle on the basis of the setting condition (step S1).

Specifically, the saddle stitching control section 505 calculates the thickness of the sheet bundle accumulated on the saddle unit 341 on the basis of the setting condition (type, basis weight and the number of sheets to be saddle stitched).

Then, the saddle stitching control section 505 determines the movement amount according to the thickness of the sheet bundle (step S2).

Specifically, the saddle stitching control section 505 refers to the storage unit 505*a* and determines the movement amount according to the thickness of the sheet bundle calculated in step S1.

Next, the saddle stitching control section 505 moves the inserting unit 351 (step S3).

Specifically, the saddle stitching control section 505 drives the drive motor 352*a* to rotate the eccentric cams 352*c* by a predetermined angle and moves the push-out member 352*d* to move the inserting unit 351 (main body 351*a* and cover 351*b*) by the determined movement amount.

Next, the saddle stitching control section 505 lowers the pressing members 356 and 356 to sandwich the sheet bundle with the supporting members 362 and 362 (step S4).

Specifically, the saddle stitching control section 505 drives the drive motor M2 to rotate the arm 356 around the rotation shaft G2, and thereby lowers the pressing members 356 and 356 to sandwich the sheets on the saddle unit 341 with the supporting members 362 and 362.

Next, the saddle stitching control section 505 inserts staples with the main body 351*a* in the inserting unit 351 (step S5).

Specifically, the saddle stitching control section 505 drives the drive motor M1 to rotate the main body 351*a* in the inserting unit 351 around the rotation shaft G1 and provides a staple from the feeding port to insert the staple into the sheets.

As described above, in the embodiment, the movement section (drive mechanism 352 and saddle stitching control section 505) moves the inserting unit 351 in the direction orthogonal to the folding line along the horizontal plane according to the thickness of the sheet bundle so that the inserting unit 351 faces the folding line on the upmost sheet of the sheet bundle accumulated on the saddle unit 341.

Thus, stapling can be accurately performed at the desired position (the folding line on the upmost sheet of the sheet bundle) of the sheets regardless of the number of sheets accumulated on the saddle unit 341.

This can obtain a good appearance of the booklet after the stapling.

The embodiment includes the storage unit 505*a* to store the table as movement information regarding the thickness of sheet bundle and the movement amount of the inserting unit 351, and the movement section determines the movement amount of the inserting unit 351 on the basis of the movement information stored in the storage unit 505*a*.

Thus, the movement amount can be determined on the basis of the movement information which has been stored in advance.

In the embodiment, the inserting unit 351 includes biasing members 355 and 355 to bias the inserting unit 351 toward the base end portion thereof. The movement section includes the drive motor 352*a*, the shaft 352*b* which is rotated by the drive motor 352*a*, the eccentric cams 352*c* connected to the shaft 352*b*, the push-out member 352*d* which is provided to abut with the base end portion of the inserting unit 351 and move toward or away from the inserting unit 351 in accordance with the rotation of the eccentric cams 352*c*, and the saddle stitching control section 505 which drives the drive motor 352*a*.

Thus, the inserting unit 351 can be moved in the X direction by a simple configuration.

In the embodiment, the supporting unit 354 extending in the direction orthogonal to the movement direction of the inserting unit 351 is provided near the inserting unit 351. The inserting unit 351 includes the main body 351*a* which is rotated toward the sheet bundle and the cover 351*b* provided above the main body 351*a*, and the cover 351*b* includes the protruding portion 351*d* abutting with the supporting unit 354.

Thus, since the protruding portion 351*d* abuts with the supporting unit 354 when the main body 351*a* is rotated to staple the sheet bundle, it is possible to prevent the inserting unit 351 from plunging out forward due to the impulse of rotation when a staple is inserted into the sheet bundle.

In the embodiment, the initial position of the inserting unit 351 is set to be the position where the inserting unit 351 is to be located when the sheet bundle accumulated on the accumulating section has the largest thickness.

Thus, the inserting unit 351 is moved for a smaller distance when the sheet bundle has a larger thickness, the setting is difficult to shift, and the concern of the staple buckling can be reduced.

Figure 12:
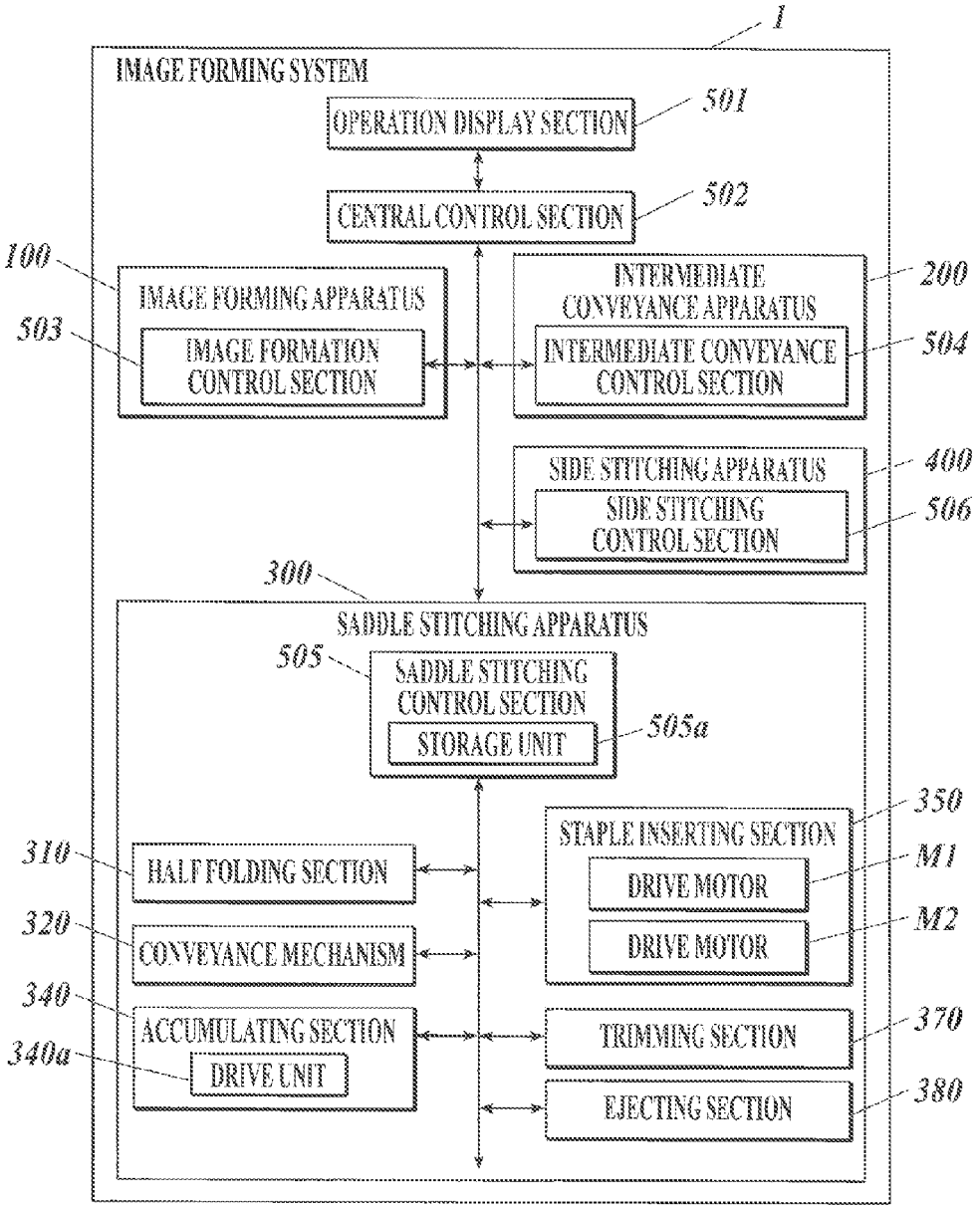
FIG. 12 is a block diagram showing another configuration of the image forming system.
Figure 13:
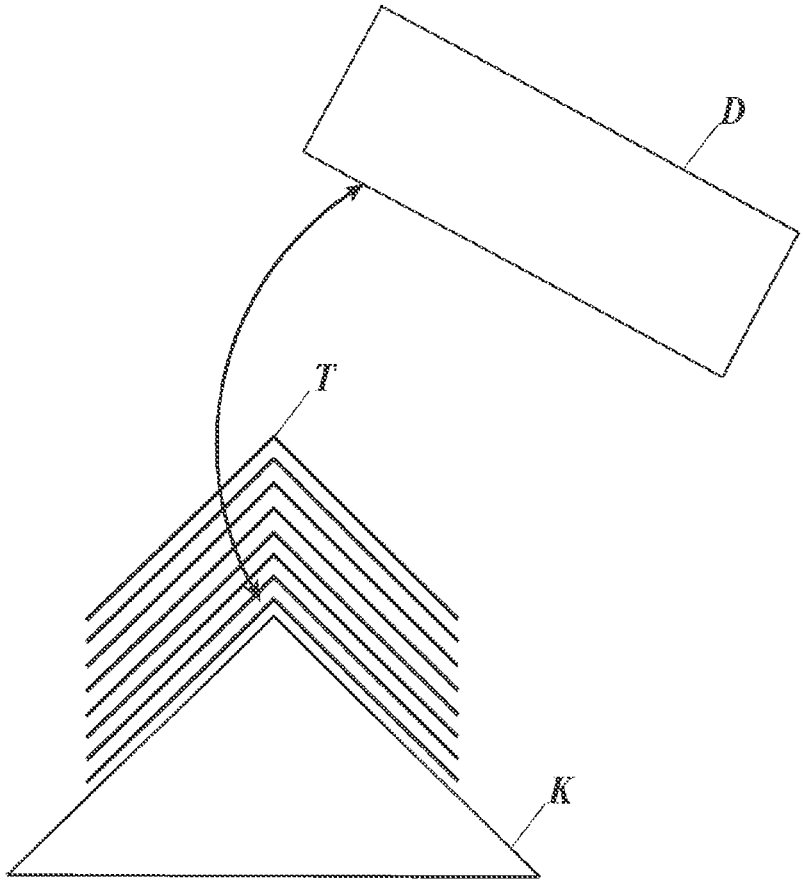
FIG. 13 is a view for explaining a problem in conventional techniques.

Though the embodiment has been described by illustrating a configuration in which the inserting unit 351 is moved, the inserting unit 351 may be fixed and the saddle unit 341 may be moved in the X direction. In such case, as shown in FIG. 12, the staple inserting section 350 does not include the drive mechanism 352, and the accumulating section 340 includes the drive unit 340*a* to move the saddle unit 341 in the X direction. The table associating the thickness of the sheet bundle with the movement amount of the accumulating section 340 is stored as movement information in the storage unit 505*a*, for example, and the movement section determines the movement amount of the accumulating section 340 on the basis of the movement information stored in the storage unit 505*a*.

Though the embodiment has been described by illustrating the configuration in which the inserting unit 351 is moved in the X direction by the drive mechanism 352, a drive unit which drives the standing portion S2 in the X direction may be provided instead of the drive mechanism 352.

A drive section which inclines the saddle unit 341 may be provided instead of the drive mechanism 352 so that the sheets are accumulated on the saddle unit 341 with the folding lines forming a circular pattern in a sectional view by inclining the saddle unit 341 with the drive section.

Though the embodiment has been described by illustrating the saddle stitching apparatus 300 which performs saddle stitching to half-folded sheets as the sheet processing apparatus, the sheet processing apparatus may be an apparatus (side stitching apparatus) which performs side stitching to staple unfolded sheets.

For example, the stapling section of the side stitching apparatus 400 in the embodiment may include an accumulating section to accumulate unfolded sheets, a staple inserting section 350 provided above the accumulating section, and a staple receiving section 350 which is provided at a position facing the staple inserting section 350 so as to sandwich the sheet bundle accumulated on the accumulating section therebetween. In such case, the drive mechanism 352 and the side stitching control section 506 as a movement section moves the inserting unit 351 or the accumulating section so that the inserting unit 351 in the staple inserting section 350 faces a predetermined position on the upmost sheet of the sheet bundle.

The entire disclosure of Japanese Patent Application No. 2013-139588 filed on Jul. 3, 2013 including description, claims, drawings, and abstract are incorporated herein by reference in its entirety.

What is claimed is:

1. A sheet processing apparatus comprising:

an accumulating section including a saddle unit on which a sheet is accumulated;

a staple inserting section which is provided above the accumulating section and includes an inserting unit which inserts a staple into a sheet bundle by rotating toward the sheet bundle;

a staple receiving section which is provided so as to face the staple inserting section across the sheet bundle accumulated on the accumulating section, the sheet bundle being accumulated on the saddle unit over the staple receiving section; and a movement section which inclines the saddle unit of the accumulating section to an inclined state according to a thickness of the sheet bundle so that stapling is performed to the sheet bundle on the saddle unit while maintaining the inclined state of the saddle unit.

2. The sheet processing apparatus according to claim 1, wherein a mountain-folded sheet folded along a folding line at a middle portion is accumulated on the saddle unit so as to straddle the saddle unit, the staple receiving section is fixed inside the saddle unit so as to locate an upper part thereof at a top of the saddle unit, and the movement section moves the saddle unit in a direction orthogonal to the folding line along a horizontal plane according to the thickness of the sheet bundle so that the inserting unit faces the folding line on the upmost sheet of the sheet bundle accumulated on the saddle unit.

3. The sheet processing apparatus according to claim 1, further comprising a storage section in which movement information regarding the thickness of the sheet bundle and a movement amount of the accumulating section is stored, wherein the movement section determines the movement amount of the accumulating section on a basis of the movement information stored in the storage section.

4. An image forming system, comprising:

an image forming apparatus which forms an image on a sheet; and the sheet processing apparatus according to claim 1 which is connected to the image forming apparatus and performs saddle stitching that is stapling, along a middle folding line, the sheet having the image formed by the image forming apparatus.

5. The sheet processing apparatus according to claim 1, wherein the movement section inclines the saddle unit such that stapling is performed at a fixed position relative to the uppermost sheet of the sheet bundle regardless of the thickness of the sheet bundle.

* * * * *